United States Patent [19]

Zernig

[11] 4,007,513

[45] Feb. 15, 1977

[54] SINGLE-PIVOT HINGE

[76] Inventor: Ernst Zernig, Muhlenweg 29, 587 Hemer, Germany

[22] Filed: July 3, 1975

[21] Appl. No.: 593,333

[30] Foreign Application Priority Data

| | | |
|---|---|---|
| July 4, 1974 | Germany | 2432143 |
| Aug. 28, 1974 | Germany | 2441258 |

[52] U.S. Cl. ..... 16/128 R; 16/179; 16/140; 16/164

[51] Int. Cl.[2] ..... E05D 9/00

[58] Field of Search ..... 16/128 R, 135, 139, 16/140, 142, 146, 148, 168, 143, 145, 134, 129, 156, 163, 164, 176, 183, 180

[56] References Cited

UNITED STATES PATENTS

| | | | |
|---|---|---|---|
| 3,418,683 | 12/1968 | Stone et al. | 16/145 |
| 3,868,746 | 3/1975 | Flagg et al. | 16/128 R |
| 3,890,670 | 6/1975 | Sewing et al. | 16/129 |

*Primary Examiner*—G. V. Larkin

*Attorney, Agent, or Firm*—Pollock, Vande Sande & Priddy

[57] ABSTRACT

A hinge for a flush-type door comprising a plate member which has two integral, elongate, generally flat and mutually perpendicular portions and adapted for mounting to the door so that a first of the portions abuts the door edge and the other portion abuts an adjoining face of the door. A pivot pin is supported along a free longitudinal edge of the portion of the plate member which abuts the door edge. A hinge arm is pivotally supported on the pivot pin and is mounted to a face of the furniture member or the like to which the door is hinged. The hinge arm has a width measured along the axis of the pivot pin which is substantially less than the length of the plate member abutting the door edge. A recess is defined in the plate member whose width along the axis of the hinge pivot slightly exceed that of the width of the hinge arm so as to permit the hinge arm to be received within the recess when the door is in its closed position.

7 Claims, 14 Drawing Figures

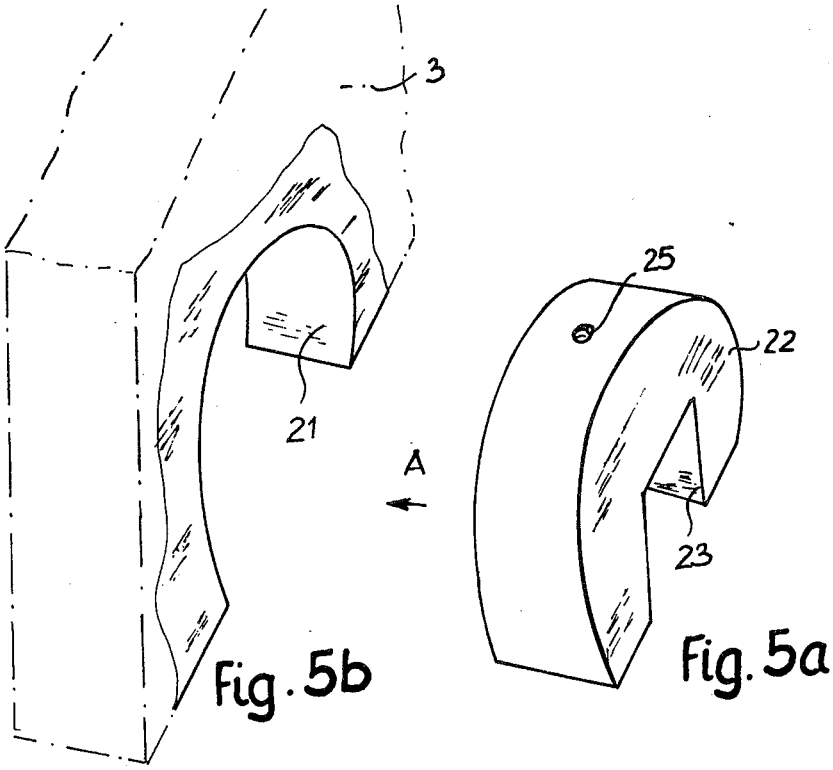
Fig. 5b
Fig. 5a
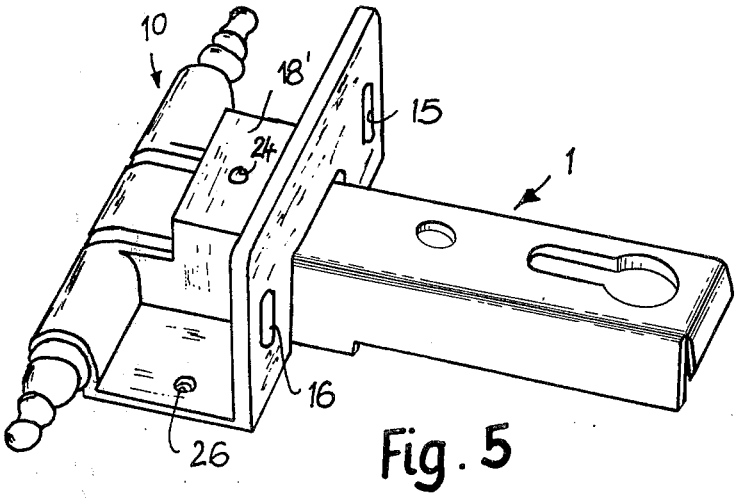
Fig. 5

Fig. 9
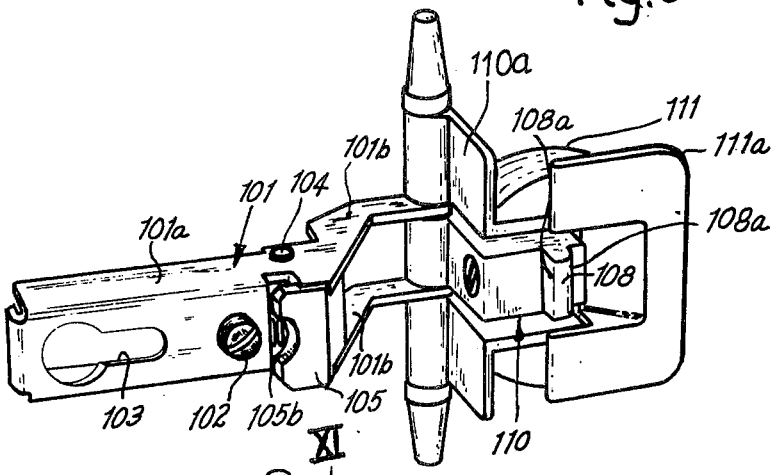
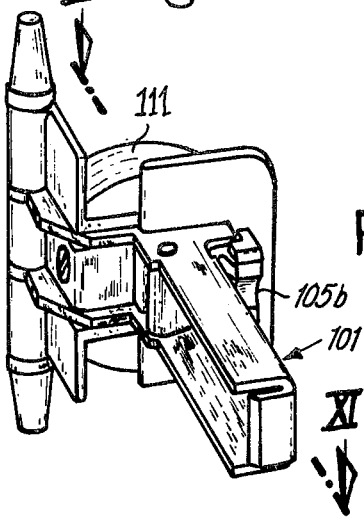
Fig. 10
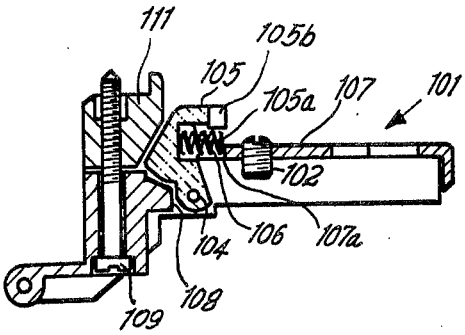
Fig. 11

SINGLE-PIVOT HINGE

BACKGROUND OF THE INVENTION

The invention concerns a single-pivot hinge, in particular for furniture having flush-mounted or recessed doors, with a single, externally visible pivot and a hinge arm of which at least a part is U-shaped in section, enclosing an adjusting plate secured to the inner surface of the furniture body, and a part extending from the pivot for securing to the door.

The present, largely usual hinges for flush doors, having a visible pivot are usually provided with two plates connected to the pivot. These plates are secured with wood-screws to the door on the one side and to the body of the furniture on the other side. This securing method is not sufficiently reliable with soft wood. The plates are, for example, set in recesses cut in edges of the furniture side walls and the door, and secured there with special screws. With another, similar embodiment the plate is screwed to the inside surface of the furniture wall. In all cases, complicated milling operations are necessary in order to sink the hinge plates. It is necessary to sink the plates in this manner for flush doors in order that when the doors are closed, the gap between the edge of the door and the side wall of the furniture body is made as small as possible.

SUMMARY OF THE INVENTION

The purpose of the invention is to provide a single-pivot hinge of the above mentioned type which is simply constructed, but easy to assemble, and which can be reliably secured.

This purpose is achieved according to the invention in that the pivot end of the hinge arm comprises two parallel side parts without a connecting base, and that at least one recess is provided in the door-side part of the hinge, corresponding to the cross-section of the hinge zone it receives when the door is in the closed position.

A further suggestion according to the invention is that the door-side part of the hinge is angled to abut the end edge and the inner surface of the door, whereby the external swivel part is an extension of the part abutting the end surface of the door, and that a raised portion, across the inside of the angle is provided for locating in a recess in the door, and which has two parallel sides in planes at right-angles to the plane of the inside surface and the edge surface of the door.

According to another embodiment, the milled recess in the door has parallel sides corresponding to the width of the raised portion, whereby the end of the recess is nearer to the edge of the door on the outer surface than it is on the inner surface.

The hinge according to the invention is made up of few parts. Assembly is possible in either a milled recess or in a bore in the door. Screws can be located in positions that are easy to prepare and which provide the necessary firmness. It is especially easy, with the aid of a milling tool, to provide a recess which does not penetrate the door or which only penetrates a portion which is covered by the hinge pivot. If the bore penetrates the door, it is necessary to provide a decorative plate to cover the external area of the bore whose requirements for exactness of dimension and position are only slight.

Further characteristics of the invention are made clear in the following description, in the drawings and in the claims.

BRIEF DESCRIPTION OF THE DRAWINGS

In the following, preferred embodiments of the invention are described in detail with the aid of the drawings in which:

FIG. 5*a* shows a hinge block for the hinge according to FIG. 5

FIG. 5*b* shows portion of a door with a bore for receiving the block shown in FIG. 5*a*, FIG. 10 shows the hinge according to FIG. 9 in closed position, FIG. 11 is a section through the line XI—XI in FIG. 10.

DETAILED DESCRIPTION OF THE PREFERRED EMBODIMENTS

In the various embodiments according to FIGS. 1 to 11, like or analogous parts are indicated by the same reference symbols.

Figures 1, 2A, 2B:
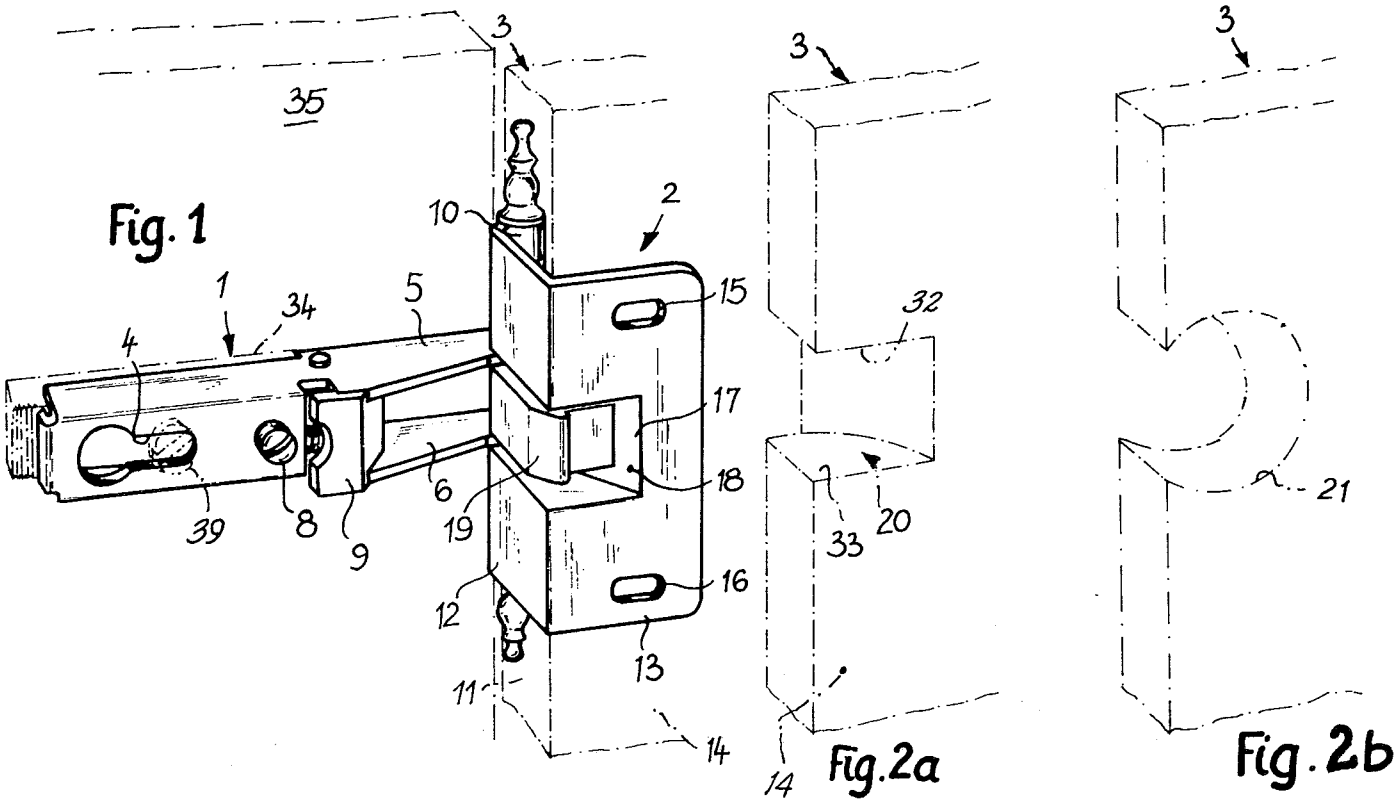
FIG. 1 is a perspective view of a first embodiment with retaining means, in open position.
FIG. 2*a* shows a first embodiment of a door area less hinge.
FIG. 2*b* shows a second embodiment of a door area less hinge.
Figure 4:
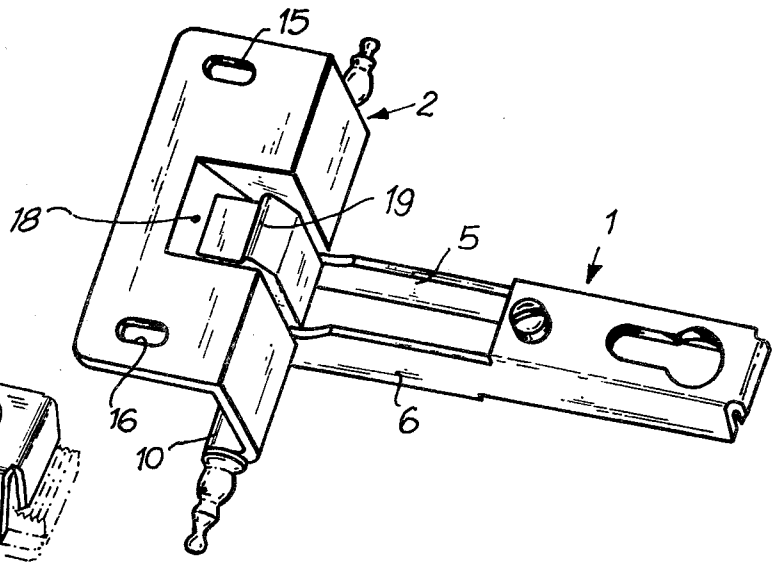

Referring to FIG. 1, a hinge arm 1 encloses an adjusting plate 34 which is screwed to the side-wall of a piece of furniture. The hinge arm 1 has a keyhole-shaped aperture 4 through which, in assembled condition, a screw 39 is fitted into a screw hole in the adjusting plate 34. The hinge arm is adjusted with an adjusting screw 8.

The hinge arm 1 is substantially straight throughout its length. The base of the U-shaped section is omitted from the right-hand end of the arm as seen in FIG. 1, so that two seperate arms, 5 and 6, are formed, which are connected to the swivel part 10. The ends of the two arms 5 and 6 are pierced by a swivel pin which is not shown, and which is carried in the cylindrical zones of the swivel part 10.

A bent or angled plate 2 adjoins the swivel part 10. This plate 2 has a first flat portion 12 lying against the edge 11 of the door 3, and a second flat portion 13, in continuation of but at right-angles to the first, lying against the inner surface 14 of the door. The second hinge-plate surface 13 is provided with elongated holes 15 and 16 which constitute a vertical or horizontally adjustable securing means for the plate 2 on the door 3 to the extent that the dimensions of the recess in the door 3 permit.

The entire width of the first flat portion 12 and a part of the second flat portion 13 is taken up by a recess 17 which is provided in the plate 2 for receiving the arms 5 and 6 of the hinge arm 1.

Figure 3:
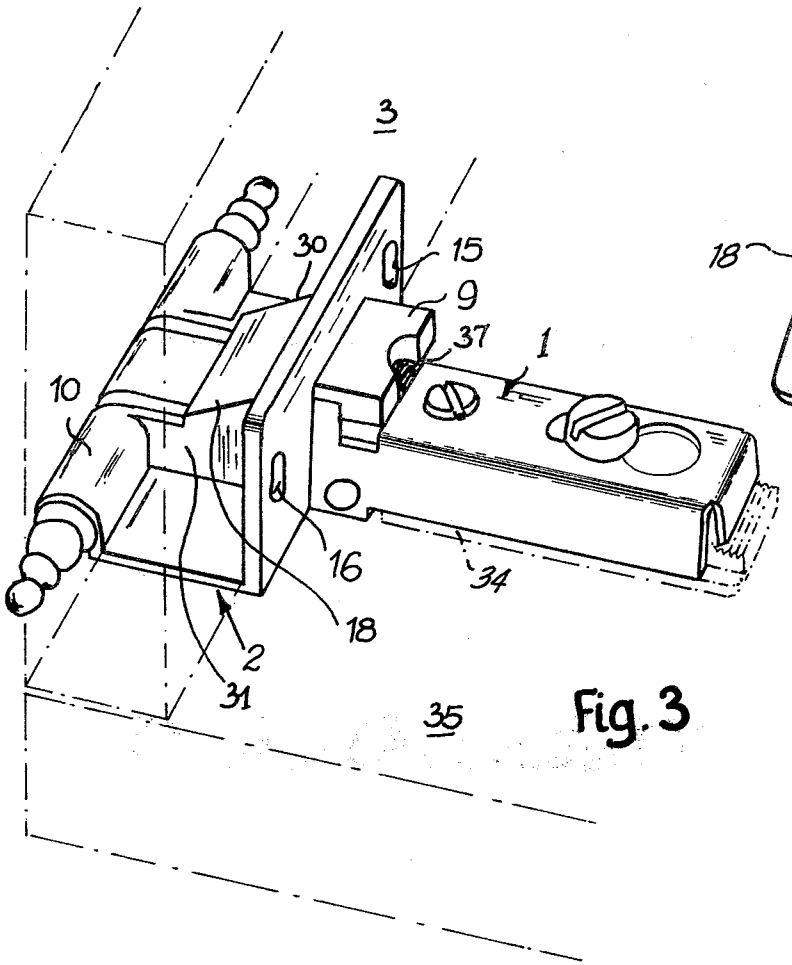
FIG. 3 is a rear view of the hinge according to FIG. 1 in closed position, FIG. 4 discloses a second embodiment of the hinge without retaining means, in open position, FIG. 5 discloses a third embodiment of the hinge in closed position.

In the embodiment shown in FIG. 1 the said recess is bordered by a supporting rib 18 of U-shaped section, which extends from the second flat portion 13 to the first portion 12. The supporting rib 18 recedes in the direction of the swivel part 10, as can be seen in FIG. 3. The side of the sloping rib 18 facing the external angle of the plate 2, is provided with a node 19 which co-operates in a known manner with the pawl 9. Slots on each side of the node 19 allow the entry of the arms 5 and 6 into the recess 17.

Figure 6:
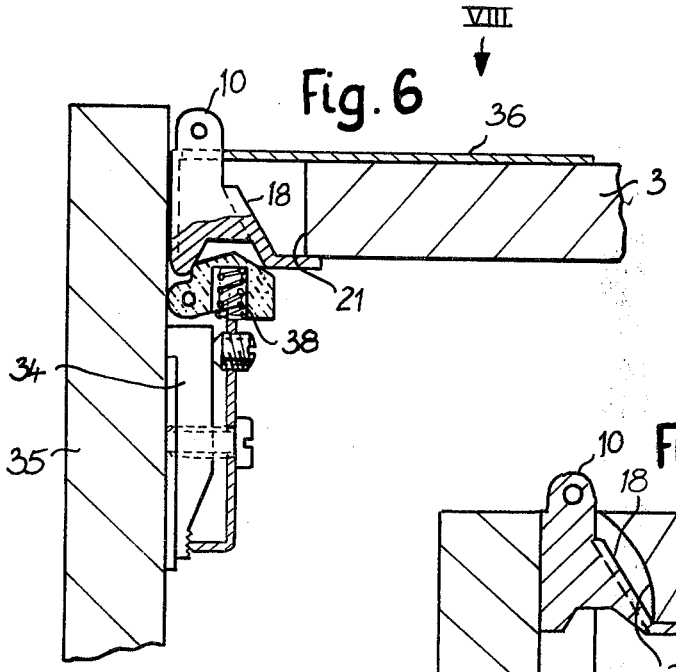
FIG. 6 is a partial section through an embodiment according to FIG. 1, assembled in a door according to FIG. 2*b*.
Figure 7:
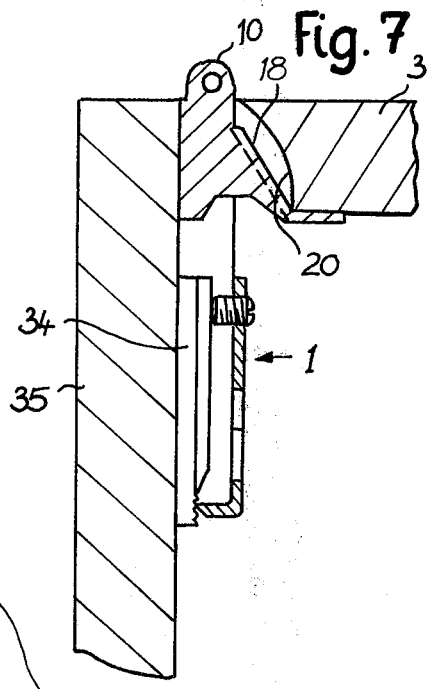
FIG. 7 is a section through the embodiment according to FIG. 4, without retaining means, assembled in a door according to FIG. 2*a*.
Figure 8:
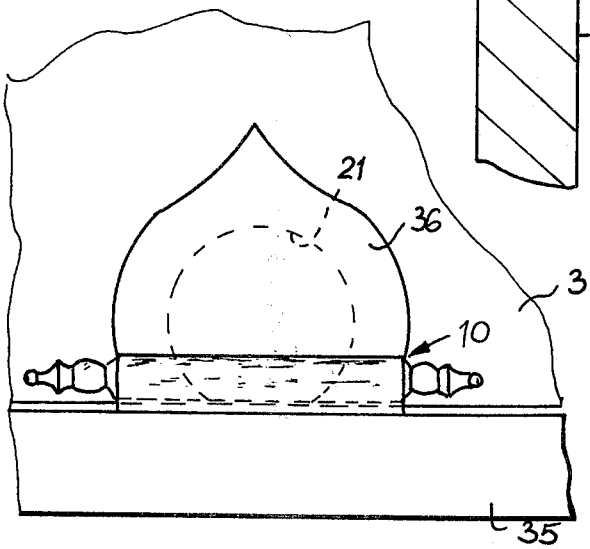
FIG. 8 is a view in the direction of the arrow VIII in FIG. 6, FIG. 9 discloses a further embodiment with retaining means and angled hinge arm in open position.

The recess 20 which can made with a milling tool, and which serves to receive the supporting rib, can be clearly seen in FIG. 2*a*. This recess acts together with the supporting rib 18 both as a locating and as an arresting means. The parallel sides 30 and 31 of the supporting rib correspond to the sides 32 and 33 of the recess 20. The plate 2 can thus be accurately postioned by such a milled recess. The method of preparing the door 3 as shown in FIG. 2*a* is especially advantageous since there is no need to cover the recess from the visible side of the door. Instead of a recess milled with a milling tool, it is possible to provide a bore which cuts the edge 11 of the door 3 as shown in FIG. 2*b*. For a bore of this kind the requirements for the exactness of position and dimension are only slight. It is, however, necessary to cover the bore on the visible side of the door with a cover plate 36, as is shown in FIGS. 6 and 8 in connection with a self-retaining hinge. A hinge without retaining means, of the type shown in FIG. 4 whereby a recess of the kind shown in FIG. 2*a* is used, is depicted in FIG. 7. As can be seen in FIG. 7, a cover plate is not required for this embodiment.

FIGS. 5 to 5*b* show an embodiment of a hinge which can be fitted, together with a block 22, into a receiving bore 21. The block 22 can be inserted, in the direction of the arrow A, into the receiving bore 21. The special feature of this embodiment is the form of the supporting rib 18' which in this case is box shaped, that is, having no receding flank, and which can be inserted into a corresponding recess 23 in the block 22. The hole 24 in the supporting rib 18' lines up with the screw hole 25 in the block 22 and receives a screw when assembled. The plate 2 is thus clamped to the block in a known manner. The holes 26 make it possible to screw the plate 2 to the edge 11 of of the door 3.

The hinge design shown in FIGS. 5 to 5*b* also requires that the block be covered on the visible side of the door.

Referring to FIGS. 9–11, a hinge arm 101 is U-shaped section. It is formed to enclose, in a known manner, a base plate which is not shown. The adjusting screw 102 abuts the base plate. In an assembled condition, the keyhole-shaped aperture contains a retaining screw as shown for example in FIGS. 3, 6 and 7.

The flanks 101*a* are not joined at the base beyond the area of the adjusting screw 102, but continue as parallel, angled extensions 101*b*. A pivot pin 104 is secured in the flanks 101*a* or the extensions 101*b*, upon which a retaining pawl 105 pivots. The retaining pawl is provided with a recess 105*a* for a spiral spring 106 the outer end of which abuts the end 107*a* of the base 107 of the U-section hinge arm 101.

The pawl is also provided with another recess in the back 105*b* which makes backward pivotal movement possible even when the adjusting screw 102 protrudes relatively far and would, were there no such recess 105*b*, abut the pawl at the farthest pivotal position tothe right (compare FIG. 3). The pawl 105 co-acts with a node 108 which is curved on both its upward face 108*a* and its downward face 108*b* to achieve the desired opening or closing behaviour. The node 108 is arranged on a central, metal part 110, the flange 110*a* of which abuts the edge of the furniture door when the hinge is assembled. The flange 110*a* is provided with cylinders containing a swivel pin upon which the cylinder of the hinge arm 101 is also secured.

The metal, center piece 110 is provided with parallel slots on each side of the node 108 for receiving the extensions 101*b* in the closed position.

The center piece 110 is screwed firmly to the hinge block 111 by means of the securing screw 109. The block 111 has a flange 111*a* on its inner side, which abuts the inner surface of the furniture part into which the cylindrical part of the block is sunken when assembled.

When the hinge is opened or closed, the pawl 105 in overcoming the node 108 is pivoted in a clockwise direction as viewed in FIG. 3.

I claim:

1. A hinge for a flush-type door comprising:

a first plate member having two integral, elongate, generally flat, and mutually perpendicular portions for mounting to one of the elements to be hingedly connected with a first of said portions abutting an edge of said one element and the other of said portions abutting a face of said element which adjoins said edge, a pivot means supported along a free longitudinal edge of said first portion of said first plate member, a hinge arm pivotally supported on said pivot means for mounting to a face of the other said element to be hingedly connected and having a width measured along the axis of said pivot means which is substantially less than the length of said first plate member also measured along said axis, said first and second portions of said first plate member defining a recess whose length along said axis slightly exceeds that of the width of said hinge arm so as to permit said hinge arm to be received within the said recess when the door is in its closed position.

2. The hinge in claim 1 wherein said recess is defined at least in part by opposing parallel sidewalls which both lie at a right angle to the plane of the edge of said one element, said recess also forming a protuberance on said first plate member to facilitate locating said first plate member in a recess cut into the edge and face of said one hingedly connected element.

3. The hinge of claim 1 which further includes a generally part-cylindrical member for mounting within a mating cylindrical bore formed in the face of said one element but with said bore communicating with the edge of said one element, said part-cylindrical member defining therein a recess in the portion thereof which faces the edge of said one element so as to receive the protuberance formed on said first plate member by its said recess.

4. The hinge of claim 1 wherein said hinge arm comprises a pair of parallel spaced ribs whose plane is perpendicular to the hinge pivot axis, and catch means supported in said recess on said first plate member and disposed between said pair of ribs when the door is in its closed position.

5. The hinge of claim 4 wherein the height of said ribs is tapered downwardly toward the location of the hinge pivot axis.

6. The hinge of claim 4 wherein said catch means co-acts with a pawl supported by said ribs on said hinge arm.

7. The hinge of claim 6 wherein said pawl is spring biased to a position where it engages said catch means when said door is in its closed position.

* * * * *